United States Patent [19]

Molnar

[11] Patent Number: 4,544,205

[45] Date of Patent: Oct. 1, 1985

[54] SEAT AND SELF-LOCKING CUSHION ASSEMBLY THEREFOR

[75] Inventor: John Molnar, Aurora, Ill.

[73] Assignee: Caterpillar Tractor Co., Peoria, Ill.

[21] Appl. No.: 504,915

[22] Filed: Jun. 16, 1983

[51] Int. Cl.[4] ..... A47C 7/18

[52] U.S. Cl. ..... 297/455; 297/223; 297/DIG. 1

[58] Field of Search ..... 297/219, 223, 452, 455, 297/DIG. 1

[56] References Cited

U.S. PATENT DOCUMENTS

| | | | |
|---|---|---|---|
| 3,712,673 | 1/1973 | Swenson | 297/452 |
| 3,713,696 | 1/1973 | Dudley | 297/452 |
| 3,924,892 | 12/1975 | Geier | 297/440 |
| 4,025,114 | 5/1977 | Cave | 297/452 |
| 4,065,181 | 12/1977 | Gunlock et al. | 297/452 |
| 4,065,182 | 12/1977 | Braniff | 297/452 |
| 4,169,627 | 10/1979 | Murphy | 297/452 |

FOREIGN PATENT DOCUMENTS

| | | |
|---|---|---|
| 1005822 | 9/1965 | United Kingdom . |
| 1425069 | 2/1976 | United Kingdom . |
| 2060367 | 10/1979 | United Kingdom . |

*Primary Examiner*—William E. Lyddane
*Assistant Examiner*—Joseph Falk
*Attorney, Agent, or Firm*—Charles E. Lanchantin, Jr.

[57] ABSTRACT

A self-locking cushion assembly (14) is connectable to and releasable from a seat shell (12) having a plurality of fingers (52,54) and a plurality of openings (56) without the use of tools or loose parts. The cushion assembly (14) includes a cushion (60) defining a plurality of recesses (62) and a peripheral frame (64) connected to the cushion (60) and having a plurality of projections (68), so that in use the fingers (52,54) extend upwardly within the recesses (62) and overlap the frame (64) and the projections (68) depend within the openings (56) in order to lockingly secure the cushion assembly (14) to the seat shell (12).

15 Claims, 7 Drawing Figures

FIG-4
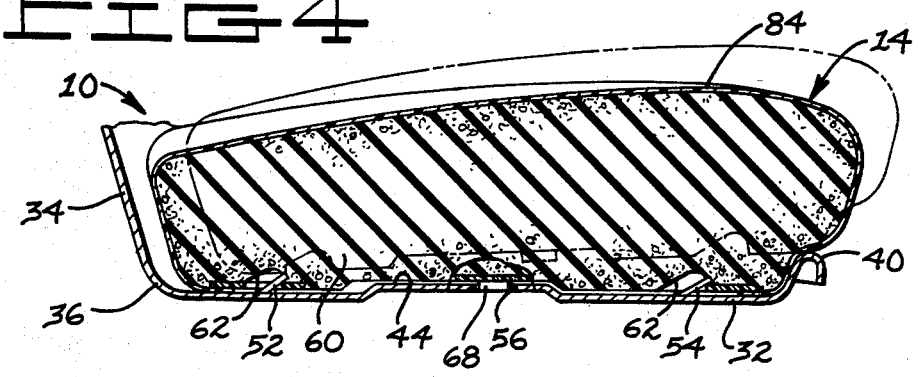
FIG-5
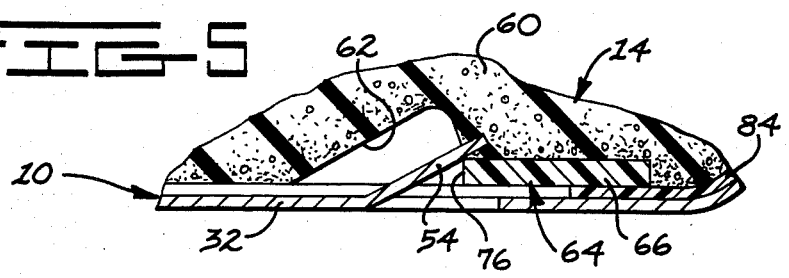
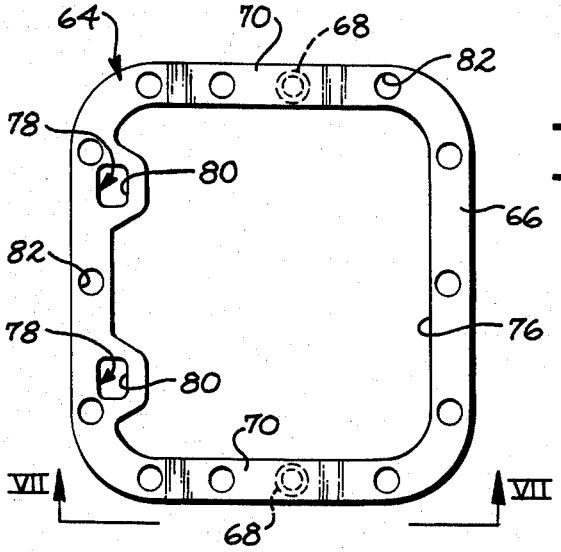
FIG-6
FIG-7
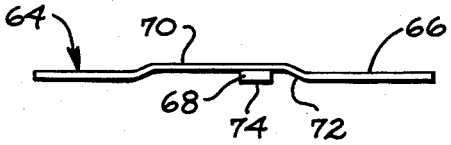

SEAT AND SELF-LOCKING CUSHION ASSEMBLY THEREFOR

DESCRIPTION

TECHNICAL FIELD

This invention relates generally to positively securing a cushion assembly to a seat shell, and more particularly to the convenient manual attachment and quick release of a cushion assembly with respect to the shell of a vehicle seat without tools and loose parts.

BACKGROUND ART

Many cushion assemblies have been secured to a seat frame by nuts and bolts requiring screwthreading of the elements. Other cushion assemblies have been secured to the frame or shell by use of clinching strips and joint clips. But these representative assemblies are undesirable because they require a considerable number of loose parts, hand tools, and relatively costly and time-consuming assembly and disassembly procedures.

The construction of U.S. Pat. No. 3,713,696 issued Jan. 30, 1973 to R. Dudley teaches use of studs secured to the pads or cushion members which are pressed into apertures in the seat pan. But such studs are sometimes of deformable or breakable plastic, so that it would be difficult to resecure the cushion members to the seat pan in a positive manner.

Still other seat assemblies, such as represented by U.S. Pat. Nos. 4,169,627 issued Oct. 2, 1979 to R. T. Murphy, et al; 4,065,181 issued Dec. 27, 1977 to D. E. Gunlock, et al; and 4,065,182 issued Dec. 27, 1977 to M. J. Braniff, et al, are unsatisfactory because they are of complex construction. For example, they require rod like latches, wires, and/or multiple rigid panel members secured to the cushion, or the like.

Accordingly, what is desired is a self-locking cushion assembly of simple and yet sturdy construction which does not require any loose parts or tools to install it positively and interlockingly on a seat shell. A further feature is to avoid the use of projecting fastening devices that can be easily broken off in use.

The present invention is directed to overcoming one or more of the problems as set forth above.

DISCLOSURE OF THE INVENTION

In one aspect of the present invention a self-locking cushion assembly is provided for releasable connection to a seat shell having a plurality of fingers and a plurality of openings. The cushion assembly advantageously includes a cushion defining a plurality of recesses, and a supporting frame connected to the cushion and having a plurality of projections. In use, the fingers of the shell extend upwardly within the respective recess and overlappingly engage the cushion supporting frame, and the projections extend downwardly within the respective shell opening.

In another aspect of the present invention a vehicle seat includes a seat shell having a plurality of fingers and a plurality of openings, and a cushion assembly including a foam cushion having a plurality of recesses and a supporting frame peripherally connected to the cushion. In use, the fingers extend inclinably upwardly within the recesses and overlappingly engage the edge of the frame, while the cushion assembly projections extend downwardly for receipt in the shell openings in order to interlockingly secure them together.

Specifically, the cushion assembly is adapted to be inserted longitudinally into a concavely formed seat shell such that inclined and integrally formed fingers on the shell extend upwardly through formed recesses in the foam cushion and overlap the edges of a relatively flat polygonal support ring moldably connected to the underside of the cushion. Then the cushion assembly is manually urged against the resilient biasing action of the foam cushion against the seat shell and/or against the action of the fingers to positively engage locking projections on the support ring of the cushion assembly with corresponding openings formed in the seat shell. Preferably, the locking projections are right circular cylinders that positively prevent movement of the cushion assembly during normal use, but which are of relatively short or stubby length to enable the projections and the opposite sides of the support ring to be urged manually and deflectably upwardly a moderate amount for quick release of the cushion assembly from the seat shell.

BRIEF DESCRIPTION OF THE DRAWINGS

FIG. 4 is partial longitudinal elevational sectional view of the seat shell and cushion assembly as taken along line IV—IV of FIG. 2;

FIG. 5 is an enlarged and diagrammatic fragmentary view of a portion of FIG. 4;

FIG. 6 is a top plan view of the supporting frame portion of the cushion assembly of FIGS. 4 and 5; and FIG. 7 is a side elevational view of the supporting frame of FIG. 6.

BEST MODE FOR CARRYING OUT THE INVENTION

Figure 1:
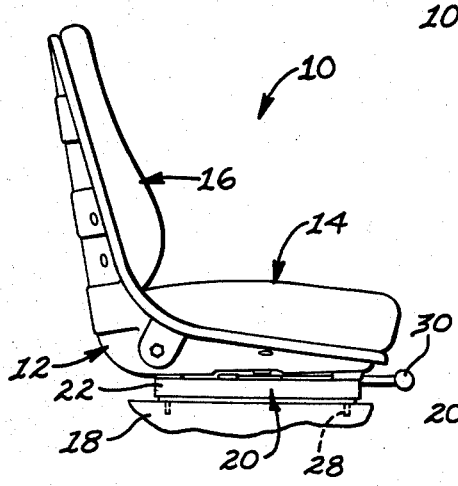
FIG. 1 is a diagrammatic side elevational view of a seat and self-locking cushion assembly therefor constructed in accordance with the present invention.
Figure 2:
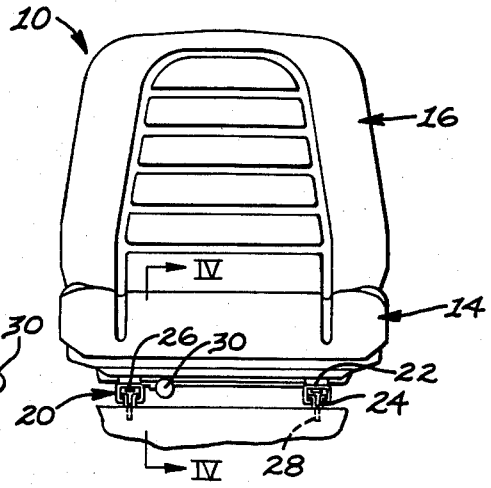
FIG. 2 is a diagrammatic front elevational view of the seat shown in FIG. 1.
Figure 3:
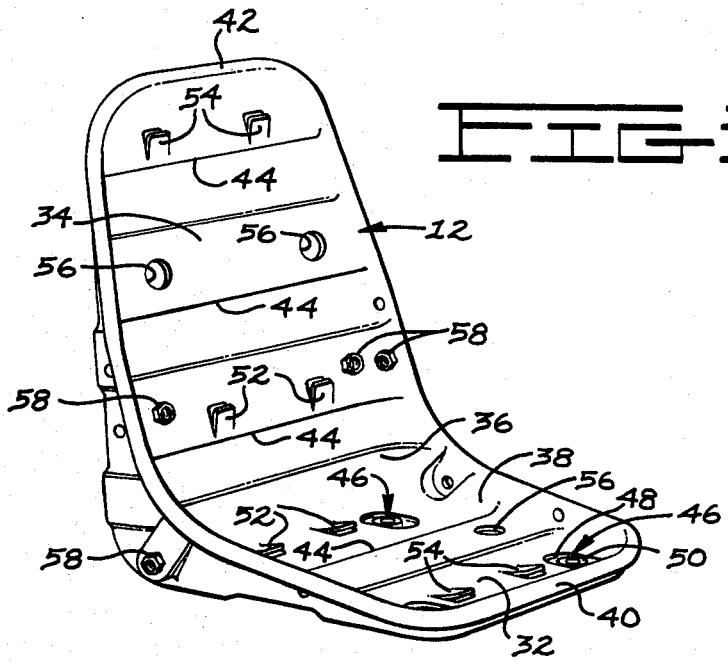
FIG. 3 is an elevational perspective view of the seat shell illustrated in FIGS. 1 and 2 showing details of construction thereof.

As shown in FIGS. 1–3, a seat 10 including a seat shell 12 and separate seat and back, self-locking cushion assemblies 14,16 is releasably mounted on a vehicle frame 18 as by a conventional positioning mechanism or seat travel adjuster 20. In the embodiment illustrated the positioning mechanism includes a pair of moveable upper rails 22 that can slide longitudinally on a pair of stationery lower rails 24. The upper rails can be releasably secured to the bottom of the seat shell by upwardly extending screwthreaded fasteners 26 and the lower rails can be releasably secured to the vehicle frame through depending screwthreaded fasteners 28 or the like. A control lever 30 can be manipulated by the operator of the vehicle to release a conventional detent mechanism, not shown, to position the rails and thus the seat in the desired longitudinal position. However, it is to be appreciated that the seat shell can be mounted on the frame in any way without departing from the spirit of the present invention.

Referring to FIG. 3, the seat shell 12 is preferably of formed sheet steel having a recessed bottom wall 32 and a recessed back wall 34 and a curved and blending lower rear intersection region 36. A pair of outwardly inclined sidewalls 38 are formed by the shell which increasingly taper in depth from an upwardly curved front edge 40 and from a top edge 42 toward the intersection region. The peripheral edge of the seat shell is preferably rolled over and the walls provided with transverse crenellations 44 for strength. Four coupling joints 46 are formed on the bottom wall in order to secure the seat shell to the upper rails 22 discussed above. Each of the coupling joints is preferably an integrally formed depending foot 48 with one or two internally threaded washers or nuts 50 welded to the shell in the depression thus formed.

Advantageously, the seat shell 12 also has a first and second pluralities of upwardly inclined fingers 52,54 integrally punched or pierced from the sheet steel, and a plurality of cylindrical openings 56 punched therethrough. Preferably, a plurality of internally threaded nuts 58 are welded to the seat shell at spaced intervals to allow optional arm rests or hip side support members, now shown, to be releasably secured to the shell by conventional fasteners in order to widen usage of the seat for a variety of vehicular applications.

The cushion assemblies 14 and 16 are basically similar in construction, so that a description of one will suffice for an understanding of the other. Accordingly, reference is made to FIGS. 4 and 5 showing the seat cushion assembly 14 as including a foam-like resiliently compressible cushion or elastomeric body element 60 defining a plurality of inner face recesses 62. As shown also in FIGS. 6 and 7, the seat cushion assembly further has a supporting frame 64 around the lower peripheral part thereof consisting generally of a plate-like polygonal ring 66 and a pair of right circular depending projections or locking pins 68 welded or otherwise firmly secured to the underside surface of the ring. The ring is substantially flat, but does have an upwardly extending portion or offset 70 at each side thereof that defines a slight downwardly facing cavity 72 so that the distal end surface 74 of each projection 68 does not extend to any substantial degree below the lower surface of the ring. The primary reason for the offset, however, is to match the offset crenelation 44 in the floor of the seat shell 12 that provides clearance for the travel seat adjuster 20. While the front portion of the ring has a rearwardly facing edge 76, a pair of generally rectangular apertures 78 are formed in the ring at the rear portion thereof in order to provide another pair of complimenting rearwardly facing edges 80 at that location. The polygonal ring illustrated also has a plurality of optional openings 82 for interlocking compatibility with the cushion material and for material reduction.

The cushion 60 is preferably formed of polyurethane foam which is initially poured in place into a mold cavity, not shown, substantially lined with a vacuum formed cover 84. The cover is preferably a fabric reinforced vinyl plastic upholstery material glued or otherwise adhesively bonded to the outer surface of the polygonal ring 66. And lastly, the supporting frame 64 is preferably made from medium impact ABS plastic material (acrylonitule-butadiene-styrene thermoplastic injection molding compound), although a ferrous material is also an option. The cavity of the mold is preferably inverted so as to place the polygonal ring at the top part of the pour mold, and the polyurethane filler material is subsequently injected into the cover which is expanded by a vacuum against the cavity walls. The filter material extends into the openings 82 to better mold the polygonal ring to the foam cushion material. The cover can be pressed against the outer surface of the polygonal ring while the adhesive is still tacky to secure it in an overlapping manner thereto. Some trimming of the cover may be necessary as required.

INDUSTRIAL APPLICABLILITY

The self-locking cushion assemblies 14,16 of the present invention are particularly adaptable to the seats of earthmoving vehicles such as wheel loaders, motor graders, scrapers and the like.

The seat cushion assembly 14, for example, can be easily manually installed into the seat shell 12 by a vehicle operator by grasping the cushion assembly in a slightly upwardly inclined and forwardly disposed position corresponding to that shown by phantom lines in FIG. 4. The front edge 40 can even serve as a partial support during this period, with the seat being disposed at an inclined downward angle of only about 3° so as to initially cause the rearwardmost shell fingers 52 to be located within the rear cushion assembly recesses 62 and within the corresponding apertures 78. As the seat cushion assembly is urged rearwardly, or to the left when viewing FIG. 4, the lower rear part of the cushion assembly makes contact with the curved intersection region 36 of the shell, while the front portion passes beyond the front edge and is being lowered. This results in a slight clockwise rotation of the cushion assembly when viewed from the side, which motion is sufficient to enable the front shell fingers 54 to pass inclinably upwardly into the front cushion assembly recesses 62. As such lowering rotational movement is continued the rear fingers 52 and the front fingers 54 pass upwardly and forwardly over the respective rearwardly facing edges 80 and 76 of the supporting frame 64 as can be visualized with reference to FIG. 6. Note that the side edges of the fingers 52 can be closely spaced within the confines of the apertures 78 so as to positively limit transverse sliding movement of the cushion assembly on the seat shell.

Preferably, the distal ends of the fingers 52,54 penetrate into the foam cushion 60 and provide a slightly increasing installation effort for the operator as the distal end surfaces 74 of the depending lock projections 68 travel rearwardly over the upper surface of the seat crenellation 44 and finally into alignment with the laterally opposite shell openings 56, only one of which is shown in FIGS. 3 and 4 because of the nature of the views. The seat cushion assembly 14 can then be forced downwardly and fully seated within the shell 12 and with the fingers overlappingly engaging the polygonal ring 66 as can be appreciated by reference to FIG. 5. The foam cushion material is sufficiently compressed by the fingers to continually exert a forward biasing force tending to retain the depending projections 68 lockingly and fully within the shell openings 56 by side loading frictional engagement.

The seat cushion assembly 14 can, of course, be manually removed by the reverse of the above assembly process without using any tools or loose parts that could be inadvertently lost or damaged. The locking projections or pins 68 are of relatively short length in order to enable the distal end surfaces 74 to be urged manually upwardly by one's fingers and beyond the confines of the openings 56 in the seat shell 12 with a limited degree of upwardly arcing deflection of the opposite sides of the polygonal ring 66. Although not illustrated in detail, the back cushion assembly 16 is installed in substantially the same manner, only by lowering it to initially engage the lower fingers 52 overlappingly into engagement with corresponding lower apertures 78 in the polygonal ring 66 thereof and the upper fingers 54 over the lower inside edge of the polygonal ring. However, the back cushion assembly ring is flat or without the deformation shown in FIG. 7 in the instant embodiment because the openings 56 for receiving the locking projections 68 are not angularly recessed to the same degree as the seat cushion assembly.

Other aspects, objects and advantages will become apparent from a study of the specification, drawings and appended claims.

I claim:

1. A self-locking cushion assembly for connection to a seat shell having a plurality of upwardly inclined fingers and a plurality of openings, comprising:

a cushion defining a plurality of inner face recesses; and a supporting frame connected to the cushion and having a plurality of locking projections depending at a right angle therefrom each of the recesses being adapted in use to individually receive one of the inclined fingers with the frame being overlappingly retained by the inclined fingers, and each of the locking projections being adapted in use to individually extend downwardly within one of the openings for releasably securing the cushion assembly to the seat shell.

2. The cushion assembly of claim 1 wherein the fingers project in use into the cushion.

3. The cushion assembly of claim 1 wherein the supporting frame includes a plate-like polygonal ring.

4. The cushion assembly of claim 3 wherein the projections are right circular cylinders connected to the polygonal ring.

5. The cushion assembly of claim 4 wherein the fingers project in use into the cushion.

6. The cushion assembly of claim 4 including a cover extending over the cushion and being connected overlappingly to the polygonal ring.

7. The cushion assembly of claim 3 wherein the polygonal ring has a pair of apertures (78), two of the fingers extending in use through the apertures and overlapping the polygonal ring.

8. In a vehicle seat, the combination comprising:

a seat shell having a plurality of upwardly inclined fingers and a plurality of openings; and a cushion assembly including a foam cushion defining a plurality of recesses and a supporting frame peripherally connected to the cushion and having a plate-like member and a plurality of locking projections extending at a right angle therefrom, each of the fingers extending within one of the recesses and into overlapping engagement with the plate-like member and each of the projections being lockingly received within one of the openings.

9. The seat of claim 8 wherein the plate-like member has a pair of apertures, two of the fingers extending through the apertures and overlapping the plate-like member.

10. The seat of claim 8 wherein two of the fingers project longitudinally into the foam cushion sufficient to create a resilient loading causing frictional loading between the locking projections and set shell openings.

11. The seat of claim 8 wherein the locking projections are right circular cylinders.

12. The seat of claim 8 including a cover extending over the foam cushion and being overlappingly connected to the plate-like member.

13. The seat of claim 8 wherein the plate-like member is generally a relatively flat polygonal ring of a construction sufficient for manually induced arcuate deflection enabling the convenient release of the locking projections from the openings of the seat shell.

14. A seat comprising:

a seat shell having a plurality of upwardly inclined fingers and a plurality of openings; and a cushion assembly including a foam cushion and a plate-like supporting frame peripherally connected to the cushion, the cushion having a plurality of inner face recesses, the supporting frame having a pair of depending right circular locking pins, the fingers individually extending within one of the recesses and overlappingly engaging the supporting frame with the locking pins being individually received in one of the openings.

15. The seat of claim 14 wherein the supporting frame includes a relatively flat polygonal ring defining a pair of apertures therein, two of the fingers extending through the pair of apertures and overalpping the ring.

* * * * *